US010886051B2

(12) United States Patent
Osipov

(10) Patent No.: US 10,886,051 B2
(45) Date of Patent: Jan. 5, 2021

(54) ELECTRICAL CONNECTOR

(71) Applicant: Ilya Osipov, Novato, CA (US)

(72) Inventor: Ilya Osipov, Novato, CA (US)

( * ) Notice: Subject to any disclaimer, the term of this patent is extended or adjusted under 35 U.S.C. 154(b) by 0 days.

(21) Appl. No.: 16/986,069

(22) Filed: Aug. 5, 2020

(65) Prior Publication Data

US 2020/0388421 A1 Dec. 10, 2020

Related U.S. Application Data

(63) Continuation of application No. 16/074,787, filed as application No. PCT/US2017/057296 on Oct. 19, 2017.

(60) Provisional application No. 62/410,786, filed on Oct. 20, 2016, provisional application No. 62/462,715, filed on Feb. 23, 2017.

(51) Int. Cl.

| | |
|---|---|
| ***H01F 7/02*** | (2006.01) |
| ***A63F 9/08*** | (2006.01) |
| ***A63F 9/24*** | (2006.01) |
| ***H01R 11/30*** | (2006.01) |
| ***A63H 33/04*** | (2006.01) |
| *A63F 9/10* | (2006.01) |

(52) U.S. Cl.

CPC ..... *H01F 7/021* (2013.01); *A63F 9/0838* (2013.01); *A63F 9/24* (2013.01); *A63H 33/046* (2013.01); *H01R 11/30* (2013.01); *A63F 2009/1061* (2013.01); *A63F 2009/1077* (2013.01)

(58) Field of Classification Search

CPC ..... A63H 33/042; A63F 9/24; H01F 7/021; H01R 11/30

USPC ..... 439/39

See application file for complete search history.

(56) References Cited

U.S. PATENT DOCUMENTS

| | | | | |
|---|---|---|---|---|
| 3,576,936 A * | 5/1971 | Fischer | A63H 33/103 | 434/224 |
| 3,655,201 A | 4/1972 | Nichols | | |
| 4,513,970 A | 4/1985 | Opresco et al. | | |
| 4,546,267 A * | 10/1985 | Urfirer | H01R 13/22 | 307/116 |
| 5,941,714 A * | 8/1999 | Gorbet | H05K 7/1442 | 439/38 |
| 6,469,901 B1 * | 10/2002 | Costner | G06F 1/18 | 361/730 |
| 6,919,787 B1 | 7/2005 | Macken | | |

(Continued)

FOREIGN PATENT DOCUMENTS

| | | |
|---|---|---|
| CN | 103418146 A | 12/2013 |
| CN | 203756659 U | 8/2014 |

(Continued)

OTHER PUBLICATIONS

International Search Report and Written Opinion issued in International Application No. PCT/US2017/057296 dated Feb. 1, 2018.

(Continued)

*Primary Examiner* — Neil Abrams

(57) ABSTRACT

Connector element includes an enclosure made of a generally non-magnetic material having an open face; an insulating plate with a plate aperture; a permanent magnet placed inside the enclosure, the magnet dimensions preventing egress from the enclosure through the plate aperture; a washer made of a conductive soft ferromagnetic material with a washer aperture being larger than dimensions of said permanent magnet, placed inside the enclosure. Also disclosed are transformable electronic devices, optionally including displays, toys and educational kits built using the self-actuating connector elements.

9 Claims, 9 Drawing Sheets

(56) References Cited

U.S. PATENT DOCUMENTS

| | | | | |
|---|---|---|---|---|
| 6,974,130 | B2 | 12/2005 | Sugden | |
| 7,322,873 | B2 * | 1/2008 | Rosen | A63H 33/042 446/124 |
| 7,828,556 | B2 * | 11/2010 | Rodrigues | H01R 13/6205 439/38 |
| 7,862,415 | B1 | 1/2011 | Ghaly | |
| 7,997,970 | B2 | 8/2011 | Katz et al. | |
| 8,187,006 | B2 * | 5/2012 | Rudisill | H01R 11/30 439/39 |
| 8,395,465 | B2 * | 3/2013 | Lauder | H01F 7/04 335/219 |
| 8,873,239 | B2 * | 10/2014 | McRae | H02J 50/10 361/728 |
| 9,111,382 | B2 | 8/2015 | Ueno et al. | |
| 9,300,081 | B2 * | 3/2016 | Rudisill | H01R 13/6205 |
| 9,597,607 | B2 * | 3/2017 | Bdeir | A63H 33/26 |
| 9,755,356 | B1 * | 9/2017 | Kim | H01R 9/2408 |
| 9,907,195 | B2 * | 2/2018 | Montazeri | H05K 5/0247 |
| 10,063,009 | B2 * | 8/2018 | Szeto | H01R 13/22 |
| 10,376,804 | B2 * | 8/2019 | Lu | F21L 4/02 |
| 10,512,853 | B2 * | 12/2019 | MacDonald | A63H 33/088 |
| 2010/0197148 | A1 | 8/2010 | Rudisill et al. | |
| 2010/0308536 | A1 | 12/2010 | Stolten | |
| 2011/0084474 | A1 | 4/2011 | Paden et al. | |
| 2012/0258436 | A1 | 10/2012 | Lee | |
| 2012/0302303 | A1 | 11/2012 | Rosendo | |
| 2013/0109267 | A1 | 5/2013 | Schweikardt et al. | |
| 2014/0363987 | A1 | 12/2014 | Hodge et al. | |
| 2016/0268729 | A1 | 9/2016 | Szeto | |
| 2018/0311566 | A1 | 11/2018 | Shin | |
| 2019/0358549 | A1 * | 11/2019 | Osipov | A63F 9/0834 |
| 2020/0161037 | A1 * | 5/2020 | Osipov | A63H 33/042 |

FOREIGN PATENT DOCUMENTS

| | | | |
|---|---|---|---|
| EP | 2130569 | A2 | 12/2009 |
| JP | 2009512484 | A | 3/2009 |
| JP | 2009291462 | A | 12/2009 |
| KR | 20070104336 | A | 10/2007 |
| KR | 1020130023842 | A | 3/2013 |
| KR | 1020160083948 | A | 12/2016 |
| WO | 2010088695 | A1 | 8/2010 |
| WO | 2010120780 | A1 | 10/2010 |
| WO | 2012158616 | A2 | 11/2012 |
| WO | 2015070321 | A1 | 5/2015 |

OTHER PUBLICATIONS

File History of parent U.S. Appl. No. 16/074,787, filed Aug. 2, 2018.

File History of related U.S. Appl. No. 16/537,549, filed Aug. 10, 2019.

Examination Report No. 1 dated Dec. 16, 2019 in related Australian Patent Application No. 2017345410.

Response to Examination Report No. 1 dated Dec. 16, 2019 filed in related Australian Patent Application No. 2017345410 dated Jan. 8, 2020.

Examination Report dated Aug. 18, 2020 in Indian Patent Application No. 201947019145 corresponding to U.S. Appl. No. 16/074,787.

Votice of Reasons for Refusal dated Aug. 4, 2020 in Japanese Patent Application No. 2019-543169 corresponding U.S. Appl. No. 16/074,787.

Notification of Opinion Submission dated Oct. 15, 2020 in Korean Patent Application No. 10-2019-7014440 corresponding to U.S. Appl. No. 16/074,787.

European Search Report dated Sep. 18, 2020 in European Patent Application No. 17861796.5 corresponding to U.S. Appl. No. 16/074,787.

Examination Report dated Aug. 28, 2020 in related non-counterpart Australian Patent Application No. 2018225026.

Notice of Reasons for Refusal dated Sep. 29, 2020 in related non-counterpart Japanese Patent Application No. 2019-567222.

* cited by examiner

ELECTRICAL CONNECTOR

CROSS-REFERENCE TO RELATED APPLICATIONS

This application is a continuation of U.S. application Ser. No. 16/074,787 filed Oct. 19, 2017, which was submitted under 35 US 371 as a national-stage application derived from the PCT/US2017/57296, which claimed priority under PCT Section 8 to the following matters: the United States of America Provisional Application 62410786 filed Oct. 20, 2016, and the U.S. Provisional Application 62/462,715 filed Feb. 23, 2017; the disclosures of all of which are incorporated by reference herein in their entirety and for all purposes.

The present disclosure relates to self-actuated electrical connectors, transformable electronic devices and toy kits enabled by such connectors.

BACKGROUND

Self-actuated connectors enable convenient means to create or break electric path supporting power or signal transmission when needed in devices where frequent mechanical engagement and disengagement of mechanical parts is needed. Some examples of such applications include, but not limited to transformable electronic devices, twisted puzzles and other toys with electronic functionality, and docking stations for mobile or movable electronic devices.

Of particular interest are connectors engaging two structural elements touching plain surfaces enabling electrical connectivity. In more general case, the adjacent surfaces of the structural elements in the vicinity of the electrically connecting element may be substantially flat, while being of more complex shape overall.

A common way to connect electrically the elements of transformable electronic devices has been the use of mechanical springloaded pins.

Some known proximity actuated mechanical connectors comprise two cylindrical magnets rotatably mounted on brackets with first cylinder rotational symmetry axis parallel to the second cylinder rotational symmetry axis. The magnets have a north pole and south pole alternatively positionable disposed on the outer surfaces of respective cylinders. The cylindrical magnets are allowed to rotate freely around the axes of the cylinders. When the magnets are brought into proximity, they actuate by rotating to engage into a position wherein the north pole of the first magnet is immediately proximate the south pole of the second magnet. The magnetic moments in this configuration are allowed to self-orient rotating relative to the plane defined by contact surfaces; the rotation in this case is restricted to the plane perpendicular to the contact plane and to the axes of the cylinders.

Magnetically actuated recessed contacts have been used to connect charging ports of electronic devices such as tablet computers, smart phones, laptop computers, etc. A typical configuration of such an electrical includes a floating contact having an exterior portion formed of electrically conductive material, an interior portion including a magnet, and a flexible circuit that includes a flexible attachment feature. The flexible attachment feature is electrically coupled to the floating contact and configured to accommodate movement of the floating contact between an engaged position and a disengaged position. The orientation of the magnet is fixed, its magnetic moment being permanently codirected with the direction of its allowed translational mechanical movement.

When brought in proximity with an electronic device having its own magnet, the connector gets actuated and engages by sliding into a connected (engaged position). When the connection is broken by application of an external force (typically manually), a mechanical spring action element built into the connector returns the magnet into the disengaged position.

Magnetically actuated electrical connectors have been used including movable magnetic elements that move in response to an externally applied magnetic field. In some embodiments, the electrical connectors include recessed contacts that move from a recessed position to an engaged position in response to an externally applied magnetic field associated with an electronic device to which the connector is designed to be coupled. In some embodiments, the external magnetic field has a particular polarity pattern configured to draw contacts associated with a matching polarity pattern out of the recessed position. In this class of devices, movable magnetic elements are connected to spring-action mechanical elements, acting akin to "pogo-pins" when actuated by a magnetic force. The movement of the magnetic elements is only allowed along the axis normal to the contact surface; while a magnetic element may be allowed to rotate around its magnetic axis, the direction of the magnetic axis is preset normal to the contact surface, and no rotation of the magnetic axis of the magnetic element is allowed. This class of connectors lacks genderless conductivity and magnetic polarity invariance, and requires additional mechanical features to ensure proper connection.

In an alternative configuration, connector components include magnetic poles with a magnetic moment disposed perpendicular to and rotatable around a center axis normal to the connecting surfaces. The magnetic moment is thus restricted in a plane parallel to the connecting surface. When two identical connecting components are brought in proximity, they self-actuate by respective magnets rotating around the axis to align themselves in opposing directions and locking the connecting surfaces into electrically conducting path.

Further, magnetically actuated electrical connectors has been disclosed comprising connector components with magnetic axes allowed to rotate in planes parallel to the contact plane. When two identical magnetic elements are brought in proximity, they actuate by rotating into a position wherein magnetic poles of each connector component are proximate respective opposite polarity magnetic poles of the connector component. Once proximately actuated, the aligned magnets provide conducting path for a stable electrical connection.

TABLE 1

| Performance | Magnetically actuated plane-restricted rotating contacts | magnetically actuated recessed contacts | Present disclosure |
|---|---|---|---|
| Genderless connectivity | + | − | + |
| Initial plane orientation invariance | + | − | + |
| translational and rotational relative movement enabled. | − | − | + |
| two-step iterative connection enabled | − | − | + |
| spring action | + | + | + |
| visual and tactile inconspicuity | − | − | + |
| tolerance to scratching, chipping, contamination | + | − | |

Table 1 compares some functionalities important for the relevant applications of the current disclosure and the incumbent solutions.

Genderless connectivity is understood as a capability to connect each connector piece to any other connector piece, and the pieces employed in each specific pair are identical without distinction between male and female kinds.

Initial orientation invariance enables to engage proximate surfaces regardless of the initial orientation of the parallel surfaces; wherein the connector pieces are attracted and form a reliable contact regardless of the initial mutual orientation of the magnets providing actuation.

Possibility of connecting plane surfaces allowing their translational or rotational relative movement, including, but not limited to, rotating elements of a carousel, a rotor wheel, or a puzzle.

Transformable electronic devices, twist puzzles and other similar applications require adjacent surfaces to move relative to each other translationally or rotationally, including, but not limited to, rotating elements of a carousel, a rotor wheel, or a puzzle.

A common task of connecting electrical paths by bringing together plane surfaces is made more practical and convenient when it can be achieved in a two-step procedure, wherein the plane surfaces are first engaged, and then their relative position is manually adjusted interactively until the magnets engage and proximity-actuate electrical connection.

Contact elements providing spring-like action, without the use of springs or other elastic materials, resisting to a certain limit an external force pulling the connecting plane surfaces apart;

Connector visual and tactile inconspicuity: users of toys, puzzles, or electronic devices in general need not remember about the connection, nor care about precision alignment between the connectors, nor even think or know about the presence of said connectors;

Forming reliable connection without need to keep connecting plane surfaces thoroughly cleaned or intact, tolerant to considerable presence of scratching, chipping and moderate surface contamination;

Design comprising limited number of parts, mechanically robust, not prone to breaking into sharp, small, inhalable or swallowable pieces, no sharp edges or complex geometrical shapes.

SUMMARY

The present disclosure provides a connector element including an enclosure made of a generally non-magnetic material having an open face; an insulating plate with a plate aperture; a permanent magnet placed inside the enclosure, the magnet dimensions preventing egress from the enclosure through the plate aperture; a washer made of a conductive soft ferromagnetic material with a washer aperture being larger than dimensions of said permanent magnet, placed inside the enclosure. Also disclosed are transformable electronic devices, optionally including displays, toys and educational kits built using the self-actuating connector elements.

DETAILED DESCRIPTION OF DRAWINGS

FIGS. 1A-1D illustrate the dynamic effects of magnet-washer interactions pertinent for building a stable polarity-indifferent connector.

Small spherical permanent magnets interacting with disk-shaped washers made of soft ferromagnetic magnetic material, display peculiar dynamic effects which we apply to develop electrical connectors disclosed hereby.

Figure 1A:
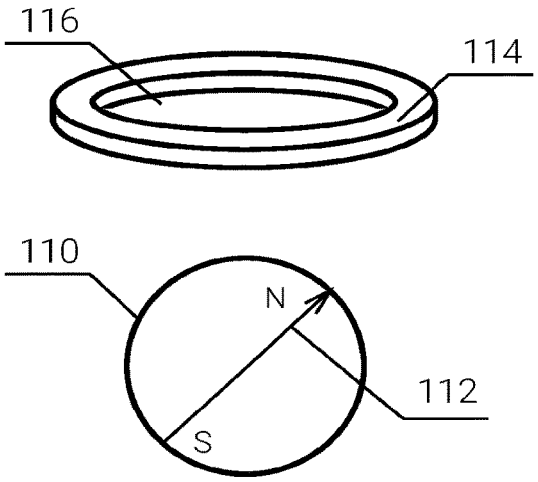
FIGS. 1A-1D show a magnet and a washer interacting in the absence of external forces.
Figure 1B:
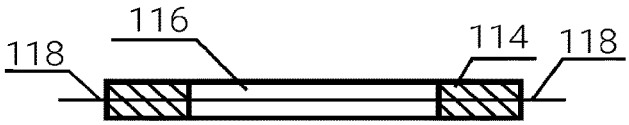

In one aspect of the current disclosure shown in FIGS. 1A-B, a magnet 110 has a north pole N and a south pole S with a magnetic axis 112 shown as an arrow connecting them. A steel washer 114 has an aperture 116 and a symmetry plane 118.

Figure 1C:
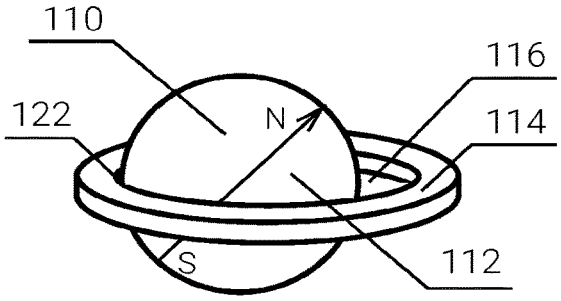
Figure 1D:
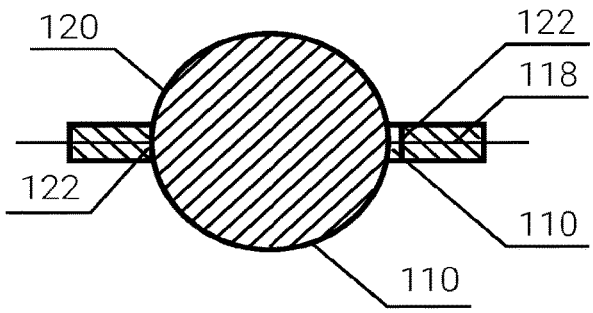

When the magnet is brought in proximity of the washer aperture, it tends to position itself as shown in FIGS. 1C-D, its diameter 120 aligned into the washer symmetry plane 118 by forces of attraction to the inside washer wall 122.

In one example, we experimented with a spherically shaped neodymium magnet 110 about 6 millimeter in diameter, a plain disk-shaped washer 112 made of generic magnetic steel with outside diameter 11 millimeter and an aperture 116 diameter 6.5 millimeter. We tried washer thickness 1.5 and 2 millimeters and observed no variation on performance.

In another example, we experimented and observed substantially the same results with neodymium magnet 110 having a diameter about 3 millimeters, washers 112 having aperture diameter 3.0 millimeter and 3.5 millimeters. As a general rule it is advisable to choose aperture diameter exceeding the spherical magnet diameter by about 10-15%.

In yet another example, the magnet may be of a non-spherical shape or/and the washer may be of not a simple disk configuration. Ball-shaped magnets can be replaced by magnets having any shape; what matters is that they should be able to rotate ensuring that magnet poles can turn under the action of the magnetic field. In such a case, the magnetic equator of an arbitrarily shaped magnet would align with the plane of a washer aperture.

The magnet 110 and the washer 114, even when axially symmetric, are mechanically unstable in the plane washer defined by the washer surfaces: as shown in FIGS. 1C-D, the magnet sticks to an arbitrary point on the inner surface 122 of the washer 114.

Figure 2A:
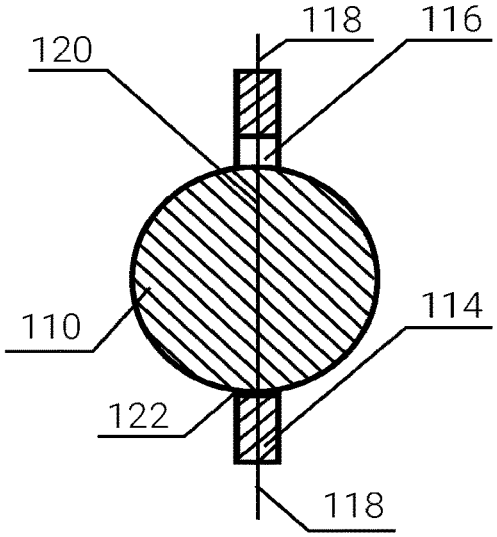
FIGS. 2A-2C show the spring action of the permanent magnet interacting with the washer when external force is applied and removed.
Figure 2B:
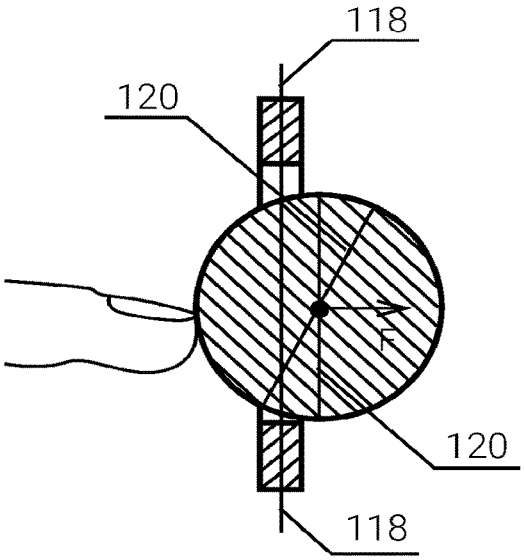
Figure 2C:
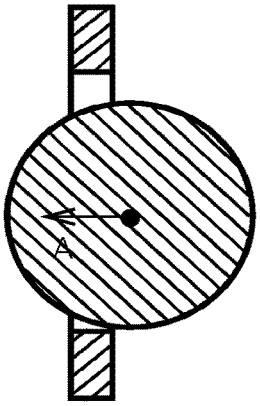

FIGS. 2A-2C illustrate and explain spring-action aspect of the connectors presently disclosed.

In this preferred configuration, the magnet 110 attaches to one of the arbitrary points on the inside surface 122 of aperture 116 of washer 114 as shown in FIG. 2A. In the absence of external acting forces, an equilibrium state is defined by alignment of a magnetic diameter 120 into the washer symmetry plane 118. If the magnet 110 is pushed or pulled out of alignment with a small external force F it moves out of equilibrium as shown in FIG. 2B. When out of equilibrium, none of the sphere diameters 120 is aligned to the washer symmetry plane 118, see FIG. 2B. When external force F is removed, the magnet is returned to the initial equilibrium state by a magnetic force A, as shown in FIG. 2C. Thus, the magnetic interaction between the spherical magnet 110 and the washer 114 made of soft ferromagnetic creates a spring-like (elastic) effect.

This effect is very useful when the ball needs to slide or roll over e.g. a flat surface. The pressure against the flat surface pushes the magnet out of equilibrium, and the magnetic force pushes the magnet against the surface, enabling friction-driven rolling when pushed laterally. It is especially useful when two connecting elements are brought together by shearing, i.e., when one surface slides over the other until magnetic balls of the mating connectors come in contact.

FIGS. 3A-3D illustrate a generalized and simplified configuration of a connector element 150 based on the operation principle disclosed in FIGS. 1A-1D and FIGS. 2A-2C.

In one aspect of the disclosure, the magnet 110 is placed inside an enclosure 128 made of a generally non-magnetic material, said enclosure having an open face 126 and closed faces 124.

The enclosure 128 may generally be of an arbitrary form, including but not limited to the example shown as open-face hollow slab or a box with five closed faces 124.

The dimensions of the enclosure 128 need to be sufficient to enable the magnet 110 to rotate freely in all directions inside it, and to choose orientation of its magnetic poles of its own accord; it is preferred, however, that the dimensions of the enclosure be sufficiently small so that the magnet 110 is maintained in proximity to washer 114 and to the front surface plate 130.

In one embodiment of the present disclosure, the internal diameter of the washer can be greater than the ball magnet diameter. This design ensures greater freedom of the ball rotation, which makes self-orientation of the magnetic poles of the ball significantly easier. A disk-shaped washer can be replaced with an element of a different shape, or a set of elements; what matters is that this element should keep the magnetic ball in a certain position without fixing it rigidly, thus ensuring that self-orientation of the poles, ball rolling, and the spring effect are possible.

In another embodiment, the washer diameter maybe smaller than the diameter of the magnetic ball; the connector may still be operable, if the magnet and the washer materials are chosen in such a way that the attracting force washer between them is relatively weak (in the opposite case, self-orientation of the ball poles is hampered).

Figure 3A:
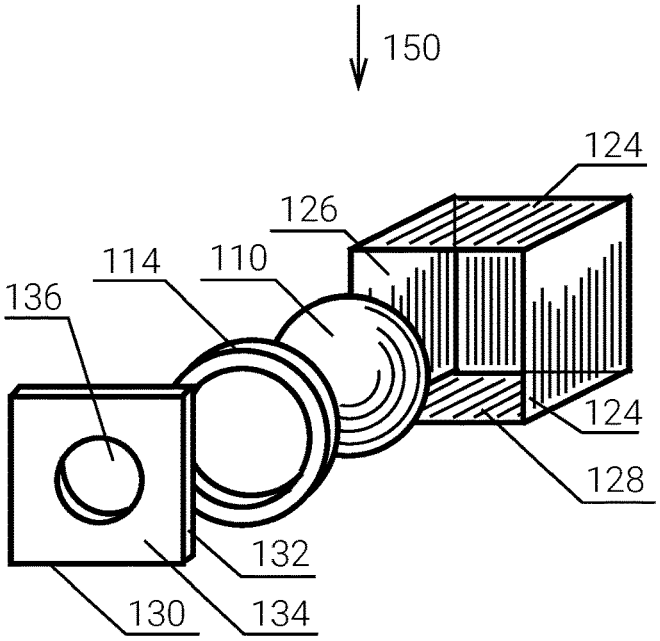
FIGS. 3A-3D show a simplified configuration of a connector element.
Figure 3B:
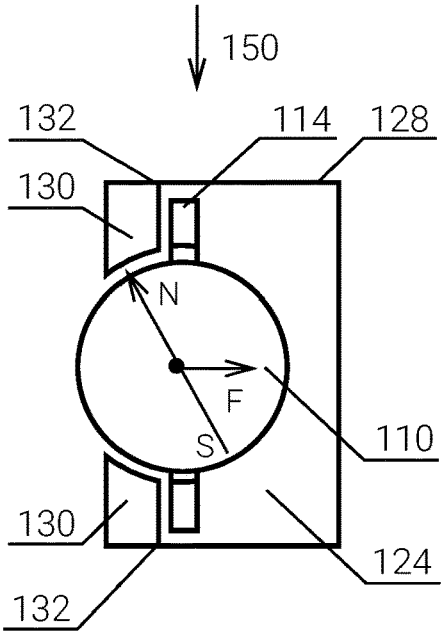
Figure 3C:
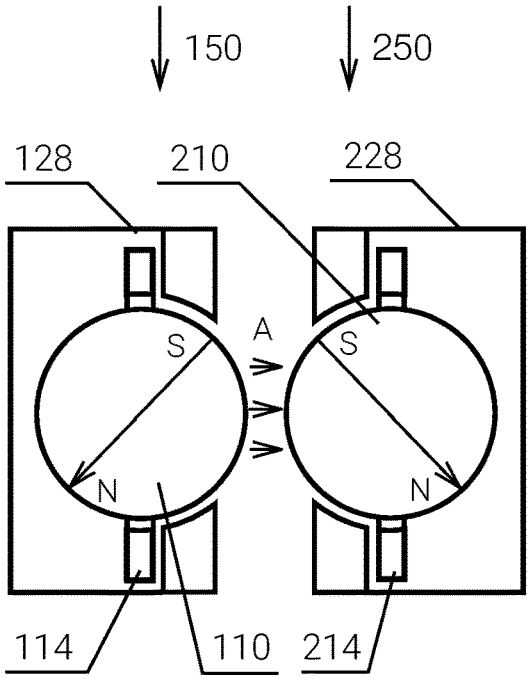
Figure 3D:
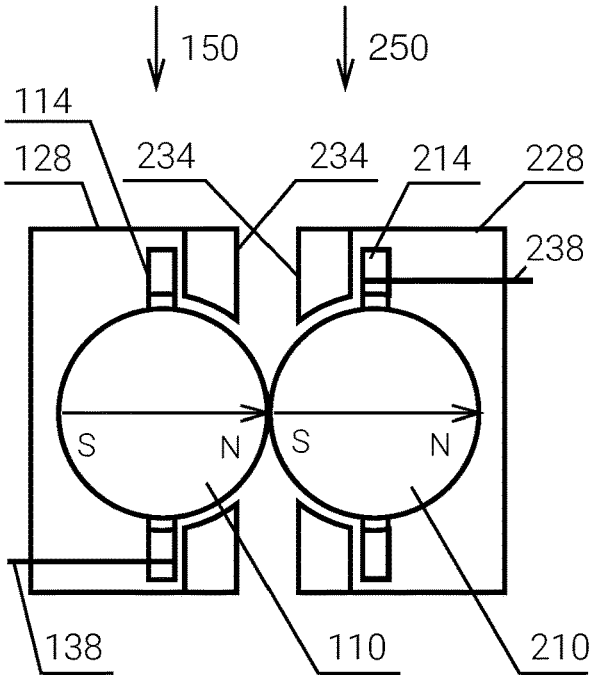

FIGS. 3B-3D illustrate a self-actuated connector wherein two connector elements of the type shown in FIG. 3A are brought in proximity.

An insulating functional face 130 comprises a circular functional surface aperture 136, the diameter of said circular functional surface aperture being smaller than the diameter of the spherical magnet 110; an enclosure-facing surface 132 and outward-facing surface 134; the functional surface aperture 136 is chamfered or beveled with a wider side adjacent the enclosure 128.

When two identical connectors 150 and 250 are brought in proximity ash shown in FIG. 3C, the magnetic poles of the respective permanent magnets 110 and 210 are self-oriented such as to be pulled together. At the same time, each magnet is attracted to the respective washer 114 and 214 made of iron or any suitable soft ferromagnetic material, thus ensuring reliable electric connection. Conductors 138 and 238 are attached to washers 114 and 214 inside the enclosure forming a connected electric path.

Figure 7A:
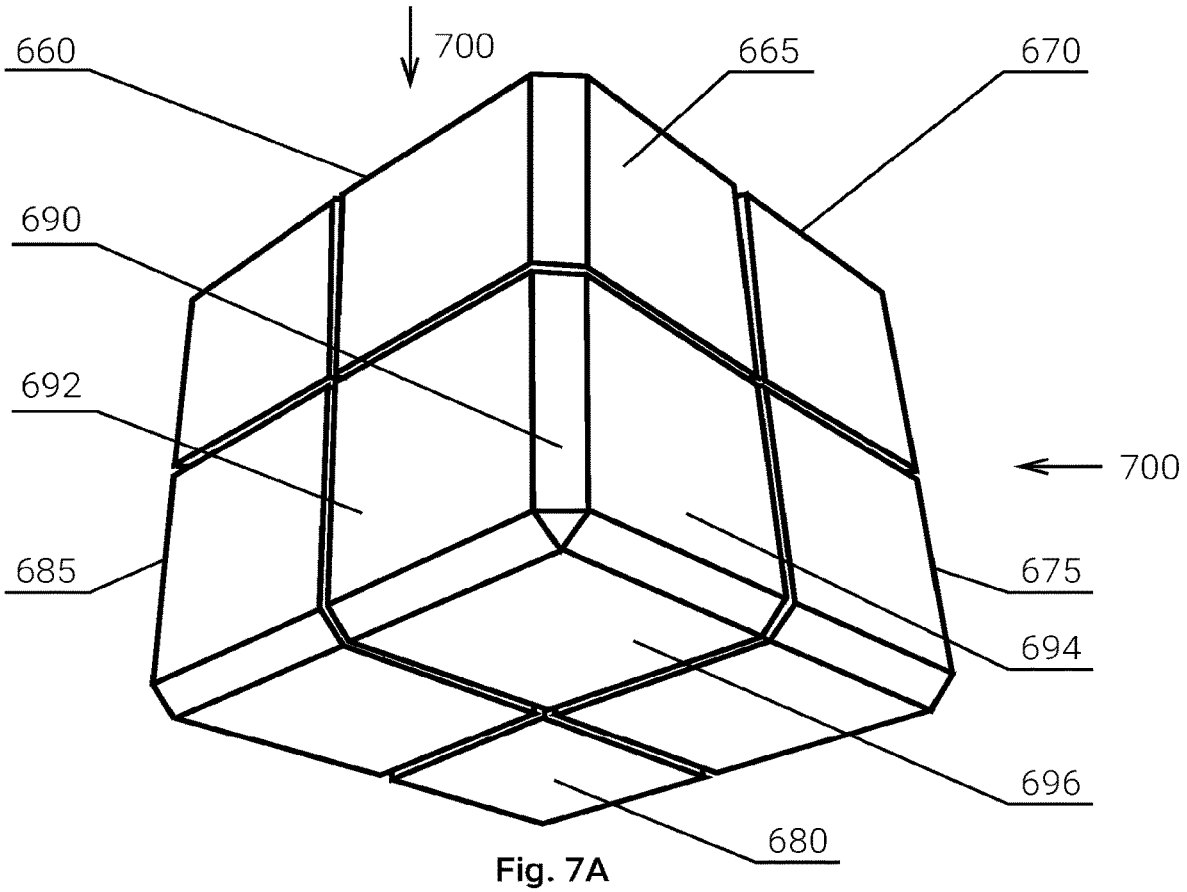
FIGS. 7A-7B show a transformative electronic display device.
Figure 7B:
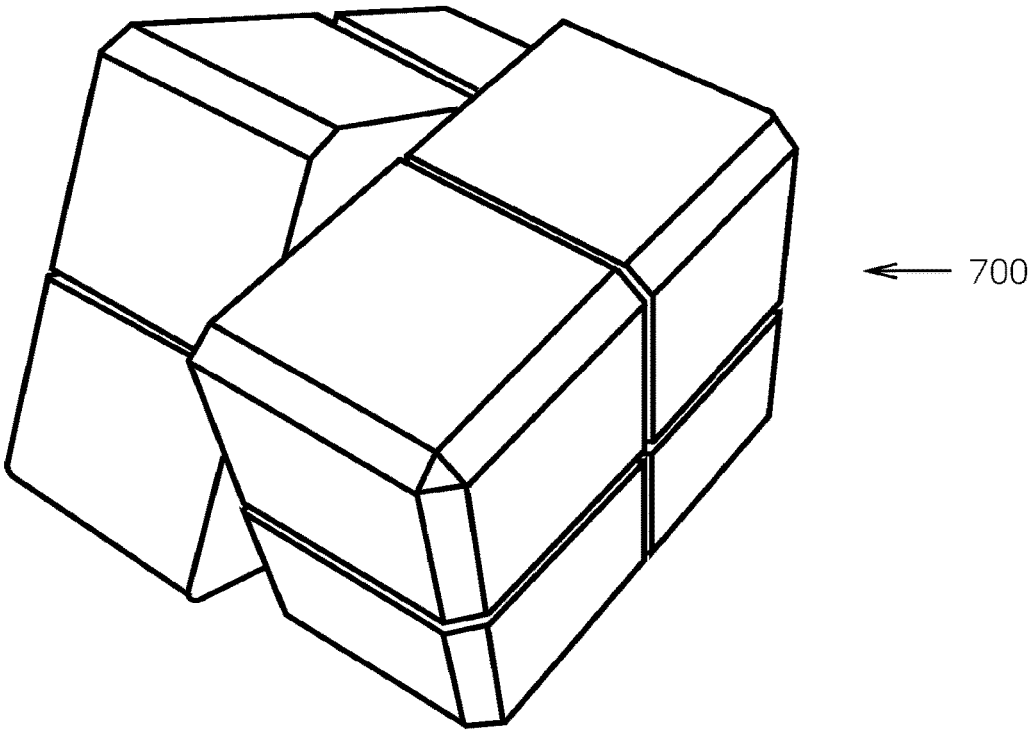
Figure 8A:
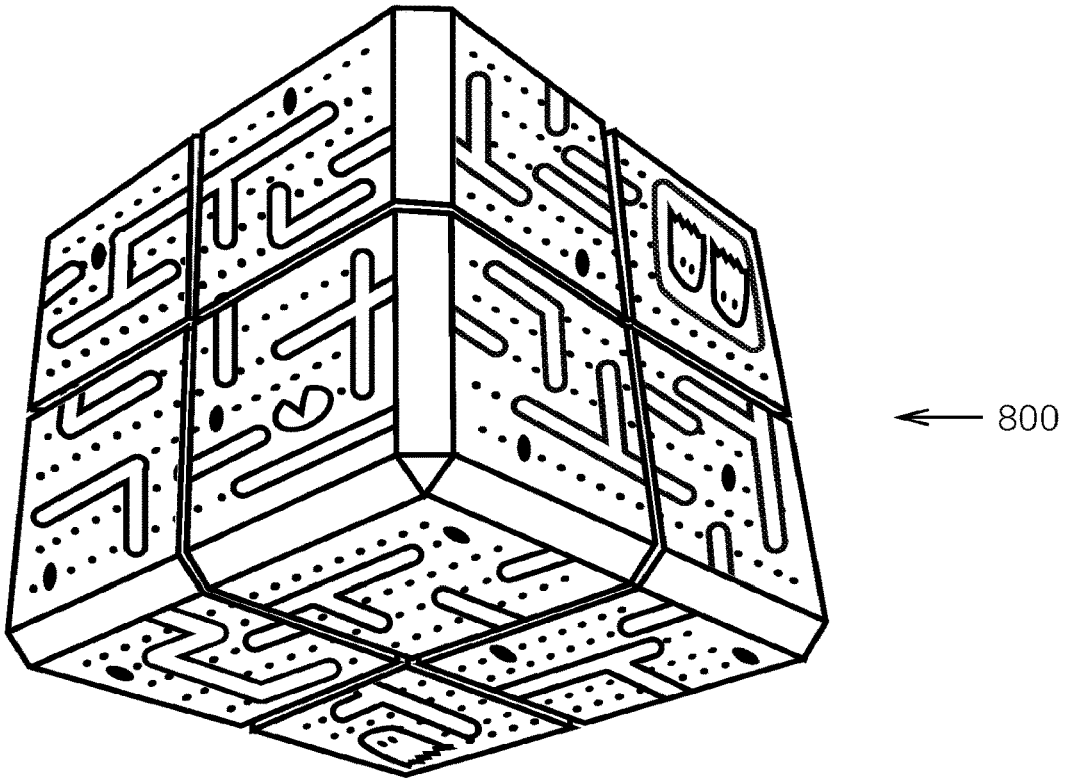
FIGS. 8A-8B show a transformative electronic display device with interactively controlled content displayed on sub-displays.
Figure 8B:
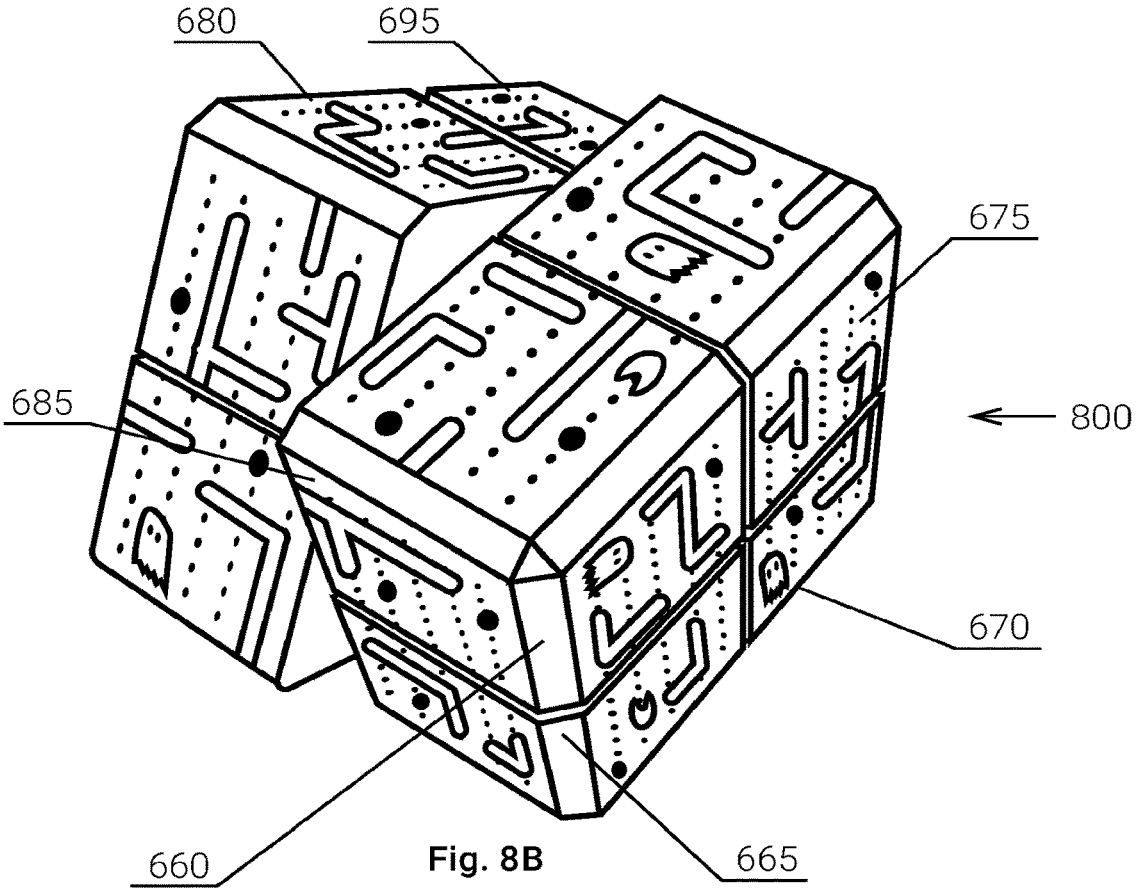
Figure 9:
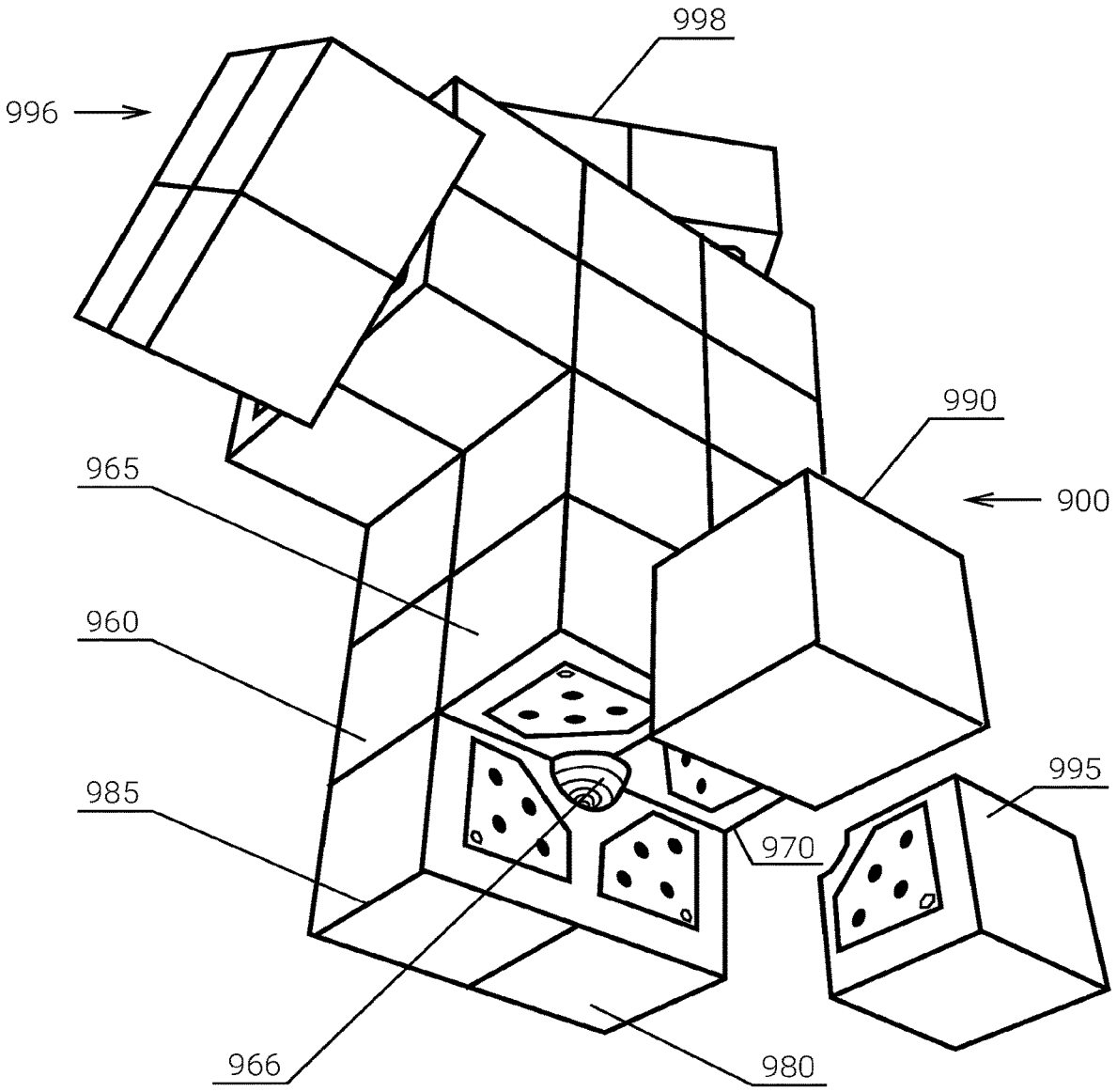
FIG. 9 shows a transformative electronic device with multiple magnetic ball joints.

The principal feature of the present disclosure is the possibility to operate successfully the planes, which can move relative to each other in the "shear" regime, as shown in FIGS. 7B, 8B and 9 below. Further figures illustrate typical applications of the connector.

In other embodiments of the present disclosure, a conducting washer may be fabricated of a magnetic material, e.g., iron, or a conductor having a different shape, but ensuring magnetic and electric contact with element.

As we discovered through extensive experimentation, the ball- or cylinder-shaped magnets need not be aligned perfectly due to presence of various gaps between the contact planes, yawns, misalignment of the details by the user, etc. However, the reliable contact is ensured by the magnetic properties of the balls or cylinders and by the space, which makes it possible to create a "slop". Thus, perfect axial alignment is not required to actuate and join such connectors.

The magnetic conductive washer and the enclosure are shaped in such a way that the ball "hides" inside the enclosure, under its surface, and, being approached by a mating connector, resurfaces, responds to the other connector, and ensures the connection. It is possible, if the force of attraction between the magnetic balls exceeds that between the ball and the magnetic washer (it is seen in the figure that the magnetic attraction force between connector magnets is greater than the magnetic force between each magnet and the respective washer, which determines that the magnetic ball moves toward the other connector, when the latter comes closer and returns to the initial position, if the mating connector moves away).

Figure 4A:
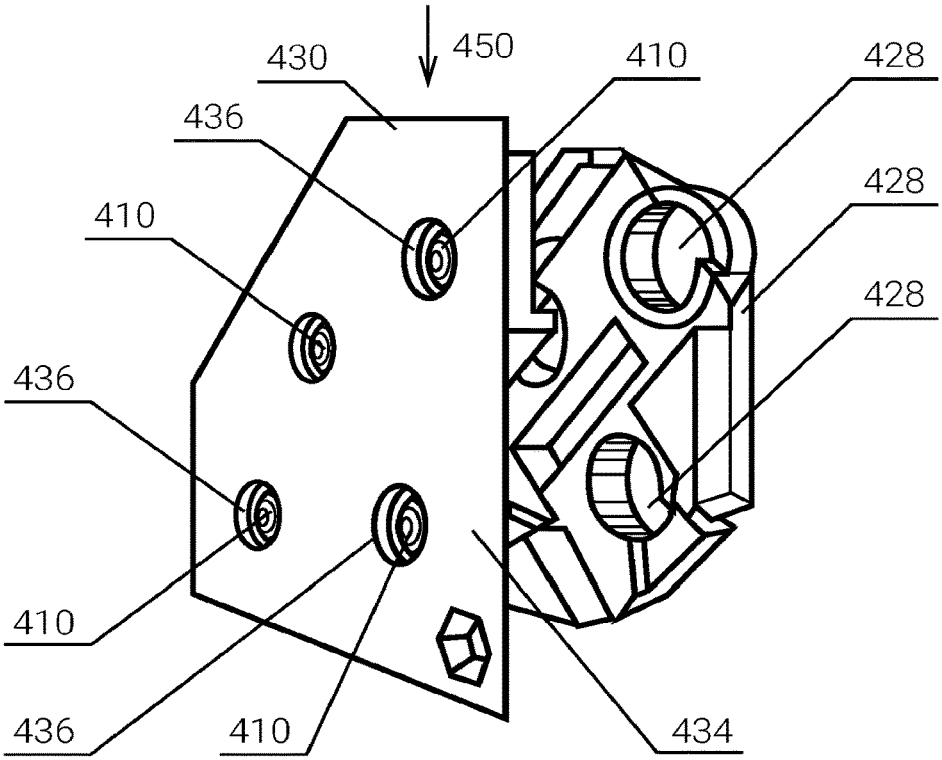
FIG. 4A-4B show a preferred configuration of the connector element.
Figure 4B:
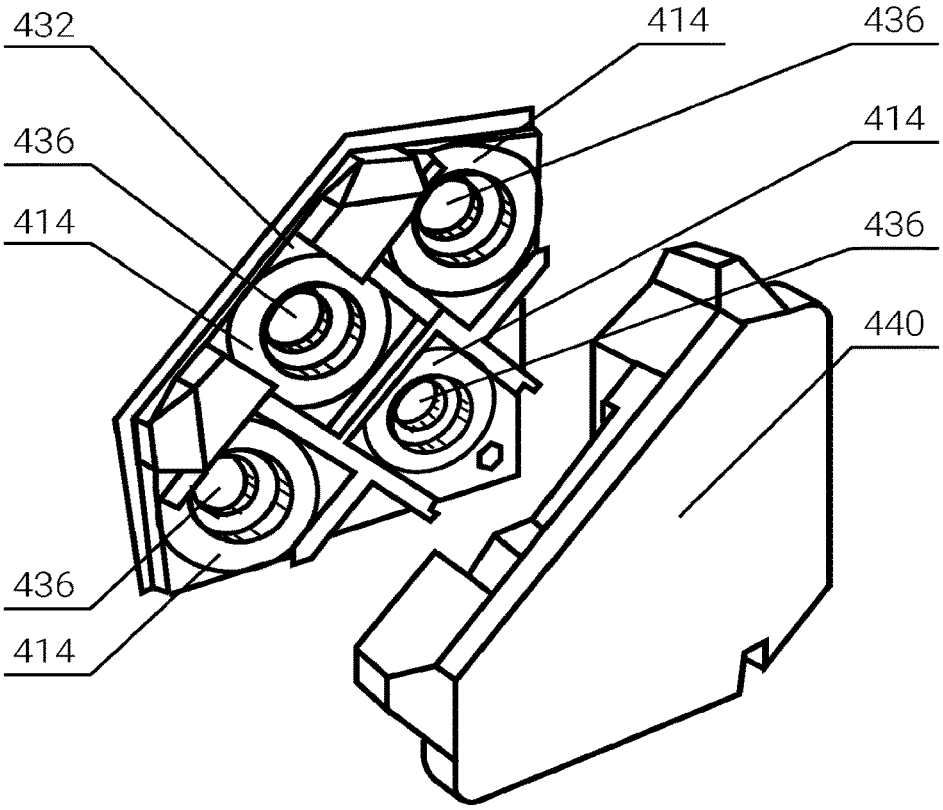

FIGS. 4A-4B illustrate a preferred configuration of a self-actuated connector element adapted for use in transformable electronic devices, puzzle toys and other similar applications.

Similarly to the simplified connector element in FIGS. 3A-3D, the connecting element 450 comprises an insulating front plate 430 fabricated from a non-conducting and non-magnetic material e.g., any plastic having appropriate properties. The front surface plate comprises four circular apertures 436 with chamfered or beveled edges.

The back plate 440 is configured to comprise four enclosures 428 shaped as partial-sphere surfaces. The apertures 436 and the enclosures 428 are sized with relation to neodymium magnets 410 as described earlier in the present disclosure. The four conductive washers 414 in this case are held immediately adjacent the enclosure-facing surface 432 of the connecting element 450.

Figure 5A:
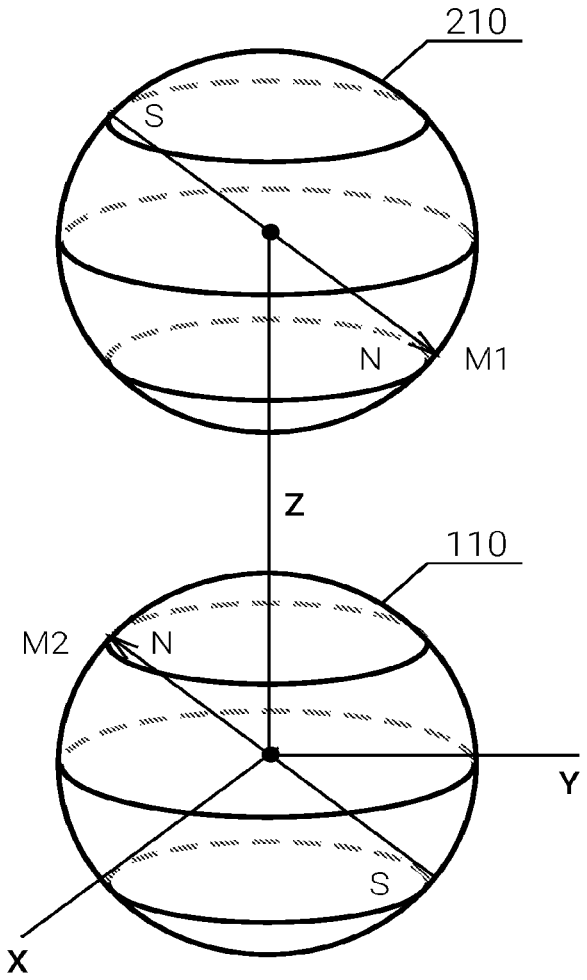
FIGS. 5A-5B show the allowed degrees of freedom for magnet rotation in the disclosed connecting elements.
Figure 5B:
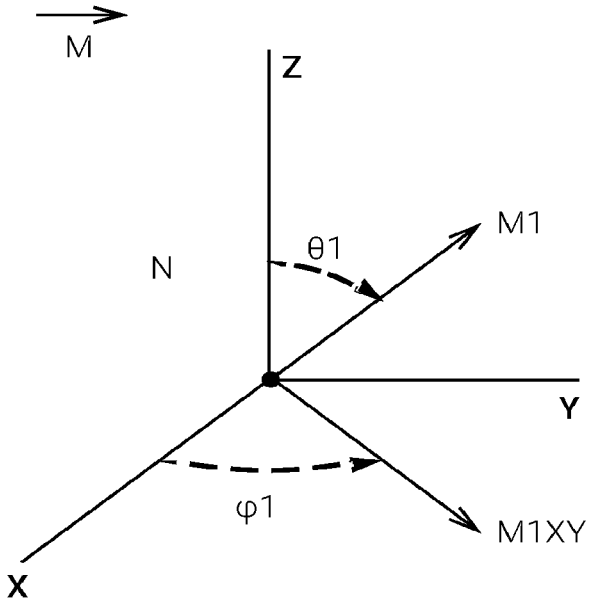

FIGS. 5A-5B illustrate the possibility for mutual rearrangement of the permanent magnets 110 and 210 when two connecting elements, similar to connectors 150 and 250 shown in FIG. 3D, or connecting elements 450 shown in FIGS. 4A-4B are brought in proximity.

The axis Z in FIGS. 5A-5B is chosen in the direction normal to the front surfaces 134 and 234 as in FIGS. 3A-3B, or 434 in FIG. 4A. Axes X and Y are chosen in a plane normal to Z, and thus parallel to surfaces 134 and 234.

Vectors M1 and M2 represent magnetic moments of the magnets 110 and 210 respectively. Vector M1XY represents the projection of vector M1 onto the XY plane perpendicular to Z axis.

The spatial direction of vector M1 in space can be fully described by the polar angle θ1 measured from axis Z and the azimuthal angle φ1 measured in plane XY between axis X and M1XY. Similarly, polar and azimuthal angles fully describe the spatial direction of M2.

The arrangements similar to the examples shown in FIGS. 3A-4B enable unrestricted rotation of magnets 110 and 210 adjusting respective polar and azimuthal angles as the connector elements are brought in proximity.

The essence of the present disclosure is that the ball- or cylinder-shaped magnets are not affixed either to the body of the connecting element enclosure, or to the washers, or any other element of the structure, or on any particular axis, and allowed to rotate around it.

Therefore, the magnets have no fixed axis set by design and are allowed to assume arbitrary orientation in space. The enclosures enable some lateral displacement in all three special dimensions, without restricting free rotation of the magnets. In its free state, with no contact with an identical connector, the magnet can be turned in any direction. However, due to the magnetic properties of the washer located at the contact point (or any other conductor having magnetic properties), the magnet ball remains in contact with this conductor due to its own magnetic properties.

Figure 6A:
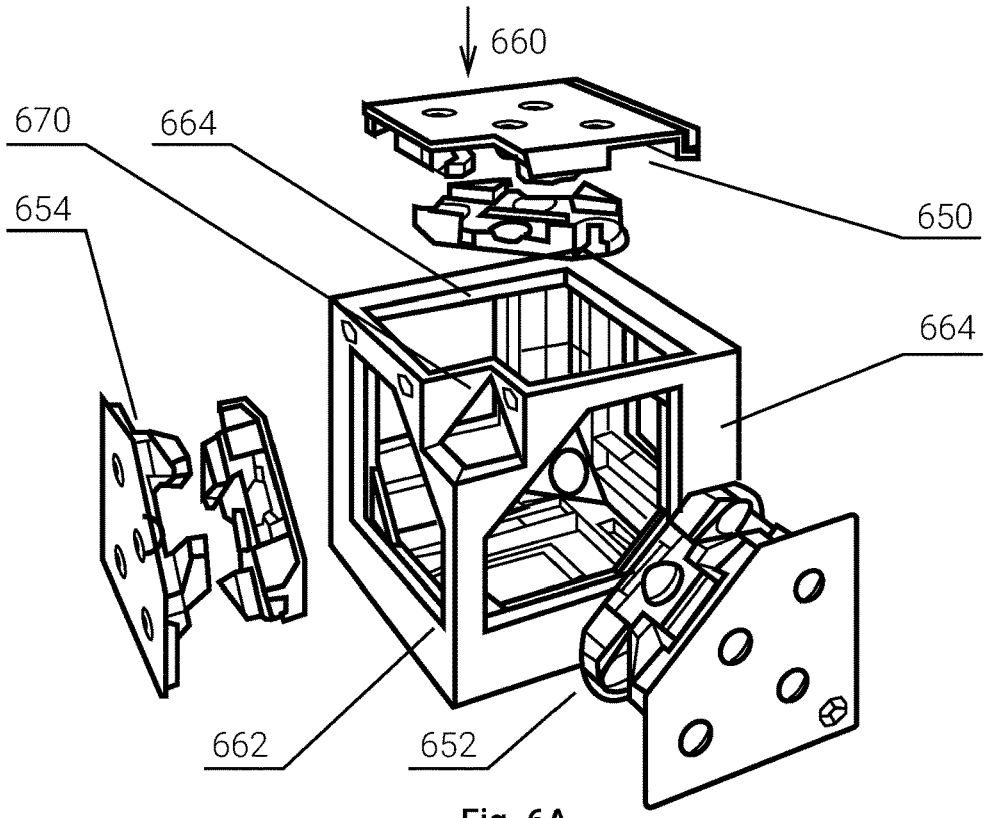
FIG. 6A shows a cubelet.

FIG. 6A shows a cubelet 660 comprising three connecting elements 650, 652 and 654. The cubelet 660 is assembled on a frame 664 of generally cubic shape with one vertex 670 (a "core vertex" hereinafter) truncated to form a convenient attachment and electrical contact to a ball joint 666 helping to form the redundant data and power distribution bus.

Bus is a common term in the industry and defines a connection mechanism through which data or power is imparted to other parts of transformable devices of the present disclosure. This bus is commonly referred to the data over power (DoP) bus and provides both the electrical and data connection necessary to interface between the cubelets. The DoP bus is comprised of connector elements exemplified in FIGS. 3A-3D, 4A4D and such, the ball joint 666, the core vertex 670 and additional bus components inside the cubelets.

Figure 6B:
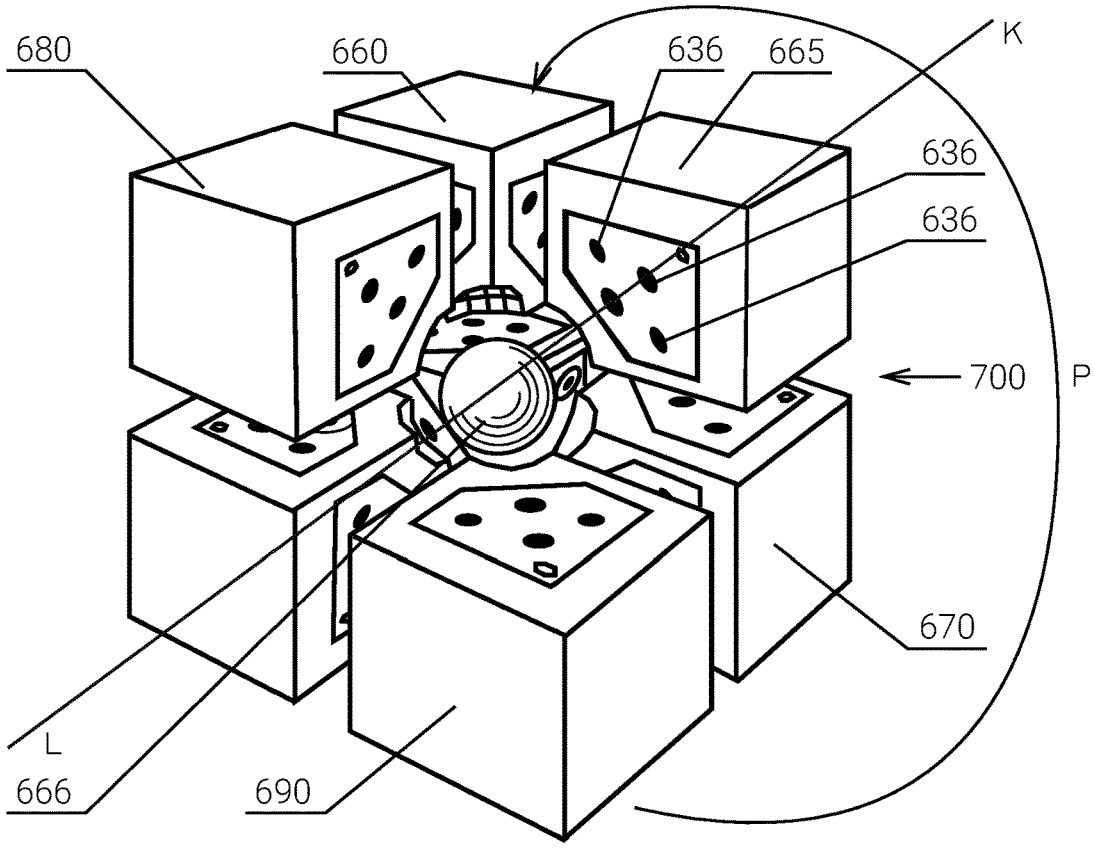
FIG. 6B shows a transformative electronic device comprising functional cubelets.

For example, the vertex may be machined into a segment of a concave sphere, the center of the sphere coincident with the cubelet vertex, and the spherical segment curvature radius substantially equal to the radius of a ball joint shown in FIGS. 6B and 9.

In other embodiments, the vertex may be shaped in other shapes, as long as they provide reliable electrical connection to form a data and power distribution bus throughout the electronic device.

The connecting elements 650, 652 and 654 are mounted on mutually perpendicular faces immediately adjacent the vertex 670. The cubelet may further comprise various electronic and electrical elements with varied functionality including but not limited to electrical passthroughs, passive electrical components (capacitors, inductors, resistors), sensors, LEDs, batteries, other charge storing devices, battery protection circuitry, diodes setting current polarities, power conditioning circuits, antennas, microprocessors converting analogue signals into digital form and vice versa, small electrical motors of various configurations, means for signal processing operations, gaming and wireless controls, display control electronic modules, wireless links, Bluetooth support functionalities, power buses, and interfaces to external computers and analogue devices. The connecting elements 650, 652 and 654 mounted on the module faces are adapted to support power and control connections between various functionalities of the adjacent modules, e.g. between module 670 and 690.

FIG. 6B show how eight cubelets 660, 665, 670, 675 (not visible), 680, 685 (removed for illustrative purposes), 690 and 695 are assembled into a cube with each module truncated vertex 670 forming a ball joint to a central element 666.

Being built into the surface of the functional building module, the connecting elements come into action (ensures transmission of an electric current and/or signals), when aligned (e.g., coaxially) with respective identical mating connectors on the surface of an adjacent the functional building module moving relative to the former.

This arrangement allows to rotate groups of four cubelets around the main three axis of symmetry of the cube. This presents an opportunity to switch and reconfigure electrical connections between the cubelets. Thus, the assembly functions as a transformable electronic device.

For example, when the group comprised of cubelets 660, 665, 670 and 675 is rotated around axis KL in the direction shown with arrow P in FIG. 6B, the four viewer-facing contacts defined by the apertures 636 switch from being connected to respective aperture contacts on the immediately adjacent surface of cubelet 685 to aperture contacts on the respective surface of the cubelet 680. Thus, the electronic elements in the module 675 are switched from a first functional configuration defined by direct electric contact to the elements of module 685 to a second functional configuration defined by direct electric contact to the elements of module 680.

During this rotational switching, the kinematic ball joint formed by the ball 666 and the adjacent truncated vertexes 670 maintains continuity of the transformable device data and power distribution bus.

These switching and transformative capabilities enable configuring sets of cubelets like 660 into functional electronic devices including but not limited to remote controls, gaming devices, communication devices and toy kits.

FIG. 7A illustrates a preferred configuration of the transformable electronic device 700, wherein information displays are attached on each outward face of every module. Each of the cubelet modules 660, 665, 670, 675, 680, 685 visible in FIG. 7A, and 690 which is not visible, has information displays attached on faces not immediately adjacent the vertex truncated to form electric contact to a central ball magnetic joint, as shown in FIGS. 6A-6B.

For the purpose of the present disclosure, transformable display means a display, consisting of separate displays of smaller size, which can change the position relative to each other; peripheral element—in contrast to the central element—located outside the device, so it can be always visible; the outward face of the peripheral element is the flat surface of the peripheral element facing the user; the inward face of the peripheral element—the flat surface of the peripheral element, facing away from the user, that is, towards a central unit.

For example, three electronic displays 692, 694 and 696 are attached to the outward-facing faces of the functional building module 690.

The electronic and electrical components inside the functional building modules are adapted to display visual content on each of the displays on the outward-facing faces of the cubelets, and to sense relative position of the functional position of the modules.

The relative position of the modules comprising the transformable device, and the change in their relative position which happens when the device is transfigured as illustrated in FIG. 7B serve as inputs for microprocessors configuring the content displayed on each of the displays.

FIGS. 8A-8B illustrate a preferred configuration of the transformable electronic display device 800, wherein smaller-size information displays (sub-displays hereinafter) are attached on each outward face of cubelets 660, 665, 670, 675, 680, 685 visible in FIG. 7A, and 690 which is not visible. The sub-displays are attached onto faces not immediately adjacent the vertex truncated to form electric contact to a central ball magnetic joint, as shown in FIGS. 6A-6B.

As shown, transforming the device from one state to another by rotating a group of four cubelets around the ball joint relative to another group of four serves as a means of inputting information that leads to interactive change in the contact displayed on the transformative display. The input variables include: composition of the rotated group of elements, direction of relative rotation, and rotation angle (typically in increments of 90 degrees). Different type of content, e.g. gaming, communication, social-network status, or remote-control inputs may be displayed and accessed using the transformative operations.

FIG. 9 illustrates yet another embodiment of the invention, the transformative electronic device 900 containing multiple ball joints like 966 coupled to cubelets like 960, 965, 970, 975 (this module is not visible in the view presented in this figure), 980, 985, 990 and 995.

These elements can be rotated around ball joints in groups of four, like e.g. groups 996, 998, and the group composed of cubelets 980, 985, 990 and 995. The outward faces of the cubelets may be equipped with subdisplays, forming a transformative display, or the video content controlled by the device rotational transformations may be fed to an external display.

What is claimed is:

1. A transformable electronic device comprising:

a ball joint comprising data and power distribution interconnect conductors;

a plurality of cubelets electrically coupled to the data and power distribution interconnect conductors, each of the plurality of cubelets comprising:

a core vertex immediately adjacent the ball joint, the core vertex truncated to form an electrical connection to the ball joint; and three display screens oriented mutually orthogonally with respect to each other and facing generally outwardly from the ball joint; and a plurality of electrical connectors electrically coupled to at least one of the display screens, each electrical connector comprising:

an enclosure made of a generally non-magnetic material and including an insulating plate comprising a plate aperture of a round shape;

a permanent magnet of spherical shape situated inside the enclosure, the permanent magnet having a diameter that is larger than the plate aperture to prevent egress of the permanent magnet from the enclosure through the plate aperture; and a washer made of a conductive soft ferromagnetic material comprising a washer aperture of a round shape, the washer aperture having a diameter that is larger than the diameter of the permanent magnet, the washer being situated inside the enclosure proximate the insulating plate, wherein the permanent magnet and the washer are magnetically attracted so as to remain in physical contact, and wherein the washer is electrically connected to at least one conductor situated within the corresponding cubelet; and at least one processor circuit situated within at least one of the plurality of cubelets and communicatively coupled to the plurality of display screens via pairs of interfaced electrical connectors;

wherein each pair of interfaced electrical connectors includes a first electrical connector and a second electrical connector, wherein the first and the second electrical connectors are movably positionable relative to one another in a first position by pivoting motion of at least a subset of the cubelets about the ball joint that causes a shearing between adjacent surfaces of the subset of the cubelets, wherein in the first position, respective insulating plates are immediately adjacent and facing each other, with respective magnets contacting each other and contacting respective washers, such that the respective magnets and the respective washers form a continuous electrically-conductive path.

2. The device of claim 1, wherein the first and the second electrical connectors are movably positionable relative to one another within a misalignment range about the first position while the continuous electrically-conductive path is maintained.

3. The device of claim 1, wherein the first and the second electrical connectors are movably positionable relative to one another in a second position wherein the continuous electrically-conductive path is broken.

4. The device of claim 3, wherein:

in the first position the permanent magnet of each electrical connector of each pair of the electrical connectors partially protrudes from its respective enclosure; and in the second position the permanent magnet of each electrical connector of each pair of the electrical connectors is recessed in its enclosure.

5. The device of claim 1, wherein the permanent magnet of each electrical connector is free to rotate to assume any orientation in response to a predominant magnetic field.

6. The device of claim 1, wherein the device has a total of 8 cubelets.

7. The device of claim 1, wherein the plate aperture is of a circular shape.

8. The device of claim 1, wherein the washer aperture is of a circular shape.

9. The device of claim 1, further comprising:

at least one battery for providing power to the plurality of cubelets, wherein the at least one battery is contained within at least one of the plurality of cubelets.

* * * * *